US008499402B1

(12) United States Patent
Arsenault

(10) Patent No.: US 8,499,402 B1
(45) Date of Patent: Aug. 6, 2013

(54) ARTICULATING TOOTHBRUSH

(71) Applicant: Peter Arsenault, Dracut, MA (US)

(72) Inventor: Peter Arsenault, Dracut, MA (US)

( * ) Notice: Subject to any disclaimer, the term of this patent is extended or adjusted under 35 U.S.C. 154(b) by 0 days.

(21) Appl. No.: 13/734,962

(22) Filed: Jan. 5, 2013

Related U.S. Application Data

(63) Continuation of application No. 12/610,312, filed on Oct. 31, 2009.

(51) Int. Cl.
*A46B 9/04* (2006.01)

(52) U.S. Cl.
USPC ..... 15/167.1

(58) Field of Classification Search
USPC ..... 15/167.1, 172, 144.1; 16/430
IPC ..... A46B 7/02
See application file for complete search history.

(56) References Cited

U.S. PATENT DOCUMENTS

| | | | | | |
|---|---|---|---|---|---|
| 2,111,880 | A | * | 3/1938 | Waters | 15/176.6 |
| 2,254,365 | A | * | 9/1941 | Griffith et al. | 15/167.1 |
| 2,429,437 | A | * | 10/1947 | Walker Maurice J | 15/172 |
| 2,864,111 | A | * | 12/1958 | Charles Rotceig | 15/168 |
| 3,193,864 | A | * | 7/1965 | Makowsky | 15/172 |
| 3,930,287 | A | * | 1/1976 | Grise et al. | 24/16 PB |
| D324,957 | S | * | 3/1992 | Piano | D4/104 |
| 5,327,608 | A | * | 7/1994 | Kosakewich | 15/22.1 |
| 5,377,377 | A | * | 1/1995 | Bredall et al. | 15/167.1 |
| 5,709,004 | A | * | 1/1998 | Paduano et al. | 15/111 |
| 6,357,073 | B1 | * | 3/2002 | Yue | 15/167.1 |
| 7,578,022 | B1 | * | 8/2009 | Schraga | 15/167.1 |
| 2006/0057087 | A1 | * | 3/2006 | Moskovich et al. | 424/65 |

* cited by examiner

*Primary Examiner* — Robyn Doan
*Assistant Examiner* — Jennifer Gill
(74) *Attorney, Agent, or Firm* — Joseph E. Funk

(57) ABSTRACT

An articulating toothbrush is disclosed that has a flexible bristle head the bristles of which may be changed between flat, concave and convex states for best brushing the fronts and backs of teeth. The change is quickly and easily made by a user of the brush by applying a force to the handle toward or way from the bristled head. The handle comprises an upper handle portion and a lower handle portion that are parallel to each other and slide with alongside each other when the user applies a linear force to the handle. Locking means are provided with the upper and lower handle portions to hold them in a position to which they are moved by applying a force to them.

15 Claims, 5 Drawing Sheets

ARTICULATING TOOTHBRUSH

CROSS REFERENCE TO RELATED APPLICATIONS

This is a continuation of U.S. patent application Ser. No. 12/610,312 entitled "Articulating Toothbrush" to Peter Arsenault with an effective US filing date of Oct. 31, 2009.

FIELD OF THE INVENTION

This invention relates to an articulating toothbrush having a head that can have the curvature of the tips of its bristles manually adjusted.

BACKGROUND OF THE INVENTION

Prior art toothbrushes are typically fixed and the ends of the bristles lie in a plane that is flat, concave or convex, or a combination of these. A toothbrush the bristles of which lie in a concave plane are best for brushing the outer surface of teeth, but are not best adapted for brushing the inner surface of teeth. A toothbrush the ends of the bristles of which lie in a convex plane are best for brushing the inner surface of teeth, but are not best adapted for brushing the outer surface of teeth. A toothbrush the ends of the bristles of which lie in a flat plane compromise between these two extremes but do not do the best job of brushing the inner surface or the outer surface of teeth.

Accordingly, a toothbrush is needed that is easily adjustable during use to configure the bristles to best brush both the inner surface and the outer surface of teeth.

SUMMARY OF THE INVENTION

The present invention is an articulating toothbrush that has a head with bristles that may easily be manually adjusted during use by a user to best brush both the inner and outer surfaces of teeth. The user of the novel articulating toothbrush may, during use, easily and quickly alter the plane in which the tips of the bristles lie to form a convex plane which is best for brushing the inner surface of teeth, and easily and quickly change the plane in which the tips of the bristles lie to form a concave plane which is best for brushing the outer surface of teeth. The user may also easily and quickly adjust the plane in which the tips of the bristles lie to be flat if they so desire.

The novel articulating toothbrush comprises an upper handle portion and a lower handle portion that are interconnected at the outer end of the bristled toothbrush head at the outer end of the upper handle portion by a flexible, living hinge. The upper handle portion comprises an upper handle and an articulating brush and the outer end. The lower handle portion comprises a lower handle and an arcuate connecting piece to the living hinge at the outer end and connecting the upper handle portion to the lower handle portion of the toothbrush. The tooth brush head at the end of the upper handle portion of the toothbrush has groups of bristles that are separated by grooves in and across the upper surface of the upper handle portion. There are also grooves in and across the lower surface of the bristled toothbrush head. The grooves on both the upper surface on the lower surface of the bristled toothbrush head collectively assist the bristled toothbrush head to bend, both upward and downward, when a force is applied thereto by the arcuate connecting piece. In this matter the plane in which the tips of the bristles lie is flat, concave or convex.

The lower handle portion of the toothbrush is slidably connected to the upper handle portion in a manner that is parallel to the axis of the upper handle portion of the toothbrush. As the lower handle portion of the toothbrush is moved linearly with respect to the upper handle portion of the toothbrush a force is transmitted via the arcuate connecting piece at the outer end of the lower handle portion of the toothbrush to the living hinge at the outer end of the upper handle portion of the toothbrush. This force causes the bristled head at the outer end of the upper handle portion of the articulating toothbrush to bend, up or down, and thereby change the surface of the plane in which the tips of the bristles lie.

In the preferred embodiment of the invention the lower handle portion and the upper handle portion of the toothbrush snap together firmly enough that the lower handle portion and the upper handle portion easily move linearly with respect to each other to adjust the bristles of the toothbrush while preventing the lower handle portion and the upper handle portion of the toothbrush from being separated from each other.

In an alternative embodiment of the invention, attached to the inner side of the lower handle portion of the toothbrush, adjacent to the upper handle portion, is an actuating button. This actuating button passes through an elongated slot through the upper handle portion of the toothbrush. A person utilizing the novel articulating toothbrush uses their thumb to move the actuating button along the elongated slot to move the lower handle portion of the toothbrush parallel to the upper handle portion of the toothbrush. As the person moves the actuating button in one direction or another the force is transmitted via the arcuate connecting piece at the outer end of the lower handle portion of the toothbrush to the outer end of the upper handle portion of the toothbrush and causes the bristled head at the outer end of the upper handle portion to bend, up or down, and thereby change the surface of the plane in which the tips of the bristles lie between flat, convex and concave.

BRIEF DESCRIPTION OF THE DRAWINGS

The invention will be better understood upon reading the following Detailed Description in conjunction with the drawing in which.

DETAILED DESCRIPTION

Figure 1A:
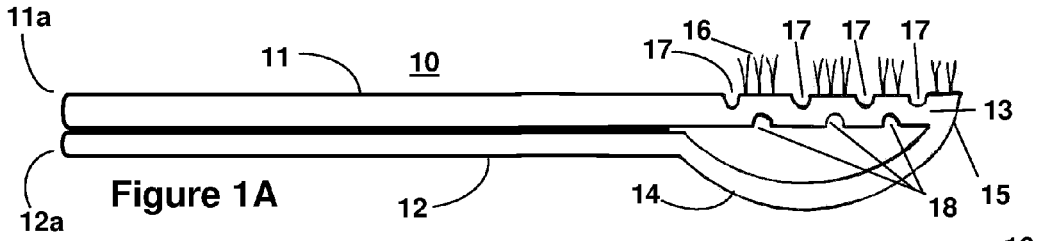
FIG. 1A shows a side view of a preferred embodiment of the novel articulating toothbrush in a neutral position in which the plane in which the tips of the bristles lie is flat.
Figure 2A:
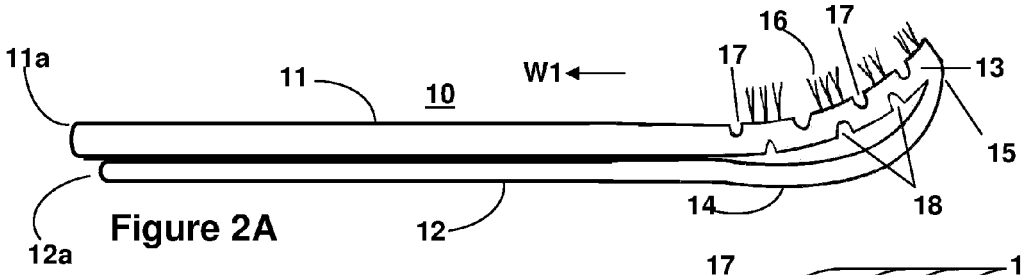
FIG. 2A shows a side view of the preferred embodiment of novel articulating toothbrush adjusted to a first position in which the plane in which the tips of the bristles lie is concave.
Figure 3A:
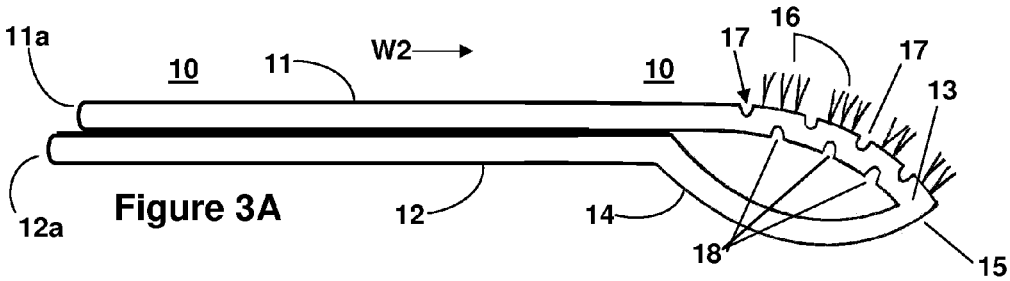
FIG. 3A shows a side view of the preferred embodiment of novel articulating toothbrush adjusted to a second position in which the plane in which the tips of the bristles lie is convex.

FIGS. 1A, 2A and 3A show three side views of a preferred embodiment of the articulating toothbrush 10 wherein the upper handle portion 11 and the lower handle portion 12 of the toothbrush handle snap together. How they snap together is best shown in and described with reference to FIGS. 4 through 7. FIG. 1A shows toothbrush 10 in a neutral state wherein the tips of all bristles 16 lie in a flat plane. FIG. 2A shows toothbrush 10 in an extended state wherein the tips of all bristles 16 lie in a concave plane that is best for brushing the outer surfaces of teeth. FIG. 3A shows toothbrush 10 in a retracted state wherein the tips of all bristles 16 lie in a convex plane that is best for brushing the inner surfaces of teeth.

Figure 15:
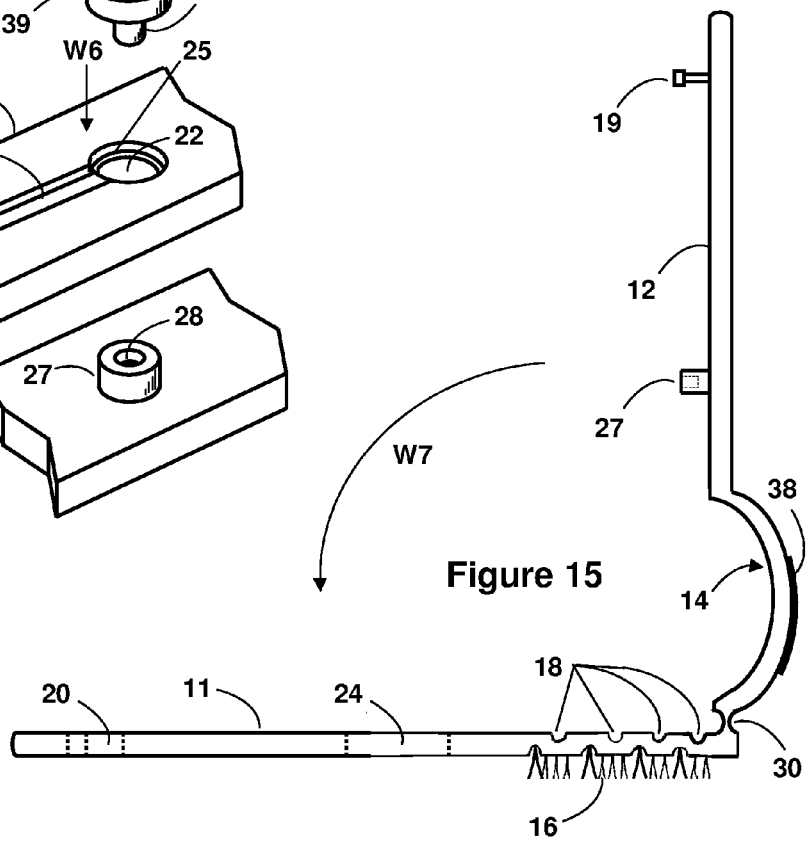
FIG. 15 shows a side view of the articulating toothbrush before the upper and lower handle portions are fastened to each other in a slidable manner.

The novel articulating toothbrush 10 is typically manufactured to appear as shown in and described in greater detail with respect to FIG. 15. When the preferred snap together version of the toothbrush is manufactured elements 19 and 27, and holes 20 and 24 are not included. Instead, the bottom side of the upper handle portion 11 has a groove formed there along as shown in and described with reference to FIGS. 4 through 7, and the top side of the lower handle portion 12 has an extension formed there along, and the groove and extension of the two handle portions snap into each other as better shown in and described with reference to FIGS. 4 through 7. The lower handle portion or half 12 of toothbrush 10 is folded in the direction of arrow W7 against and is slidably attached to upper handle portion or half 11 of toothbrush 10 as shown in FIGS. 1A, 2A and 3A.

Figure 1B:
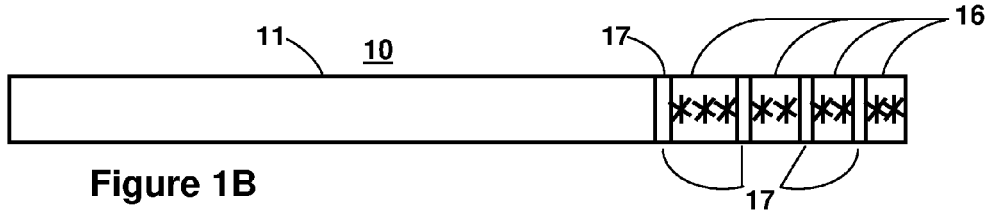
FIG. 1B shows a top view of the preferred embodiment of the novel articulating toothbrush in the neutral position in which the plane in which the tips of the bristles lie is flat.

In the articulating toothbrush 10 of FIGS. 1A&1B the upper handle portion 11 has a handle at the outer end of which is a head having bristles 16. A minimal number of bristles 16 are shown to avoid cluttering the drawing. In between each set of bristles 16 there is a groove 17 that extends across the width of the head as better seen FIG. 1B. On the underside of the bristled head there are also a set of grooves 18 across the width of the head that are vertically offset from grooves 17. The purpose of grooves 17 and 18 is to permit the head of toothbrush 10 to bend and form the arcuate shapes shown in FIGS. 2A and 3A. It should be noticed that the spacing between grooves 17 and 18 is not equal. The spacing between the two grooves 17 closest to the upper handle portion 11 of toothbrush 10 is greatest, and the spacing decreases and is a minimum between the last two adjacent grooves 17. Grooves 18 on the bottom side of upper portion 11 are located midway between each pair of grooves 17 so the spacing between pairs of grooves 18 also is not equal. The spacing between the two grooves 18 closest to the handle of toothbrush 10 is greatest, and the spacing decreases and is a minimum between the last two adjacent grooves 18.

When a force is applied perpendicular to the outer end of the upper handle portion 11 of toothbrush 10 the force causes the bristled head of toothbrush 10 to bend and form the arcuate shapes seen in FIGS. 2A and 3A. With the decreasing space between grooves 17 and 18 the outer end of the bristled head will bend more than the end of the bristled head attached to upper handle portion 11 of toothbrush 10.

To apply a perpendicular force to the outer end of the upper handle portion 11 of toothbrush 10 the lower handle portion 12 of toothbrush 10 is snap connected to upper handle portion 11 and the upper and lower portions are connected at their outer end via an arcuate member 14 as seen in FIGS. 1A through 3A. With reference to FIG. 15, during the manufacture of toothbrush 10 upper handle portion 11 is connected to lower handle portion 12 via a connection 30 having two opposing grooves. The material from which toothbrush 10 is manufactured is firm and strong enough to retain bristles 16, but is flexible enough that a living hinge is formed at connection 30 about which upper handle portion 11 and lower handle portion 12 rotate to form the toothbrush 10 shown in FIG. 1A. There are elements 19, 27, 20 and 24 shown in FIG. 15 that are not part of the snap together preferred embodiment of toothbrush 10, but are part of an alternative embodiment of the invention shown in FIGS. 8-14.

After lower handle portion 12 is snap connected to upper handle portion 11 of toothbrush 10, when lower handle portion 12 is slid linearly with respect to upper handle portion 11 a force is applied to arcuate member 14. Due to the arcuate shape of member 14 the force is resolved into a first component that is linear with the handle (11,12) of toothbrush 10, and a second component that is perpendicular to the outer, bristled end of upper portion 11. It is that perpendicular force which causes the bristled end to bend upward or downward as shown in FIGS. 2A and 3A.

In FIG. 1A upper handle portion 11 and lower handle portion 12 are in a relaxed state with respect to each other and there is no force created to bow the outer bristled end of upper handle portion 11. Thus, the tips of all bristles 16 all lie in a flat plane as shown.

Figure 2B:
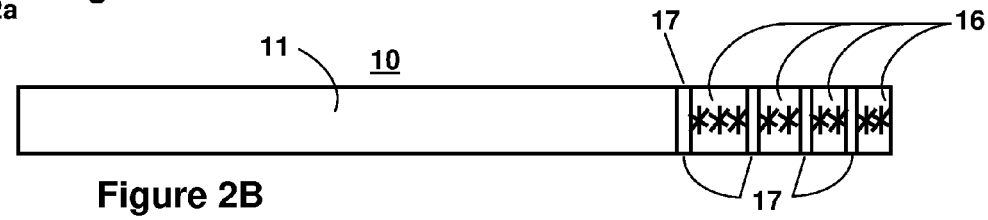
FIG. 2B shows a top view of the preferred embodiment of novel articulating toothbrush adjusted to the first position in which the plane in which the tips of the bristles lie is concave.

In FIG. 2A a force is applied to upper handle portion 11 in the direction of arrow W1. This creates an upward force at end 15 of the bristled head which causes the bristled head to bend upward creating the concave shape as shown. In this configuration the toothbrush bristles can best clean the outer surface of teeth. FIG. 2B shows a top view of toothbrush 10 when the bristled head is bent upward into the concave shape.

Figure 3B:
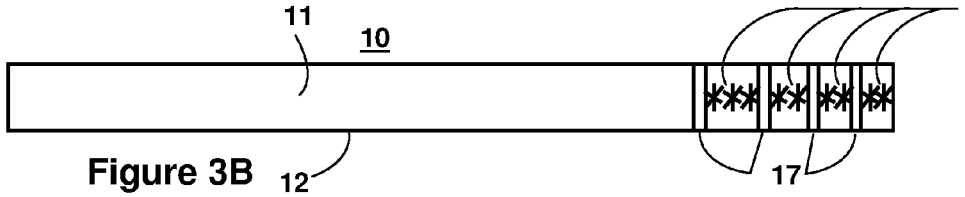
FIG. 3B shows a top view of the preferred embodiment of novel articulating toothbrush adjusted to the second position in which the plane in which the tips of the bristles lie is convex.

In FIG. 3A a force is applied in the direction of arrow W2, the opposite of arrow W1 in FIG. 2A, to slide upper handle portion 11 to the right with respect to lower handle portion 12. This creates a downward force at outer end 15 of the bristled head which causes the bristled head to bend downward creating the convex shape as shown. In this convex configuration the toothbrush bristles can best clean the inner surfaces of teeth. FIG. 3B shows a top view of toothbrush 10 when the bristled head is bent downward into the convex shape.

Figure 4:
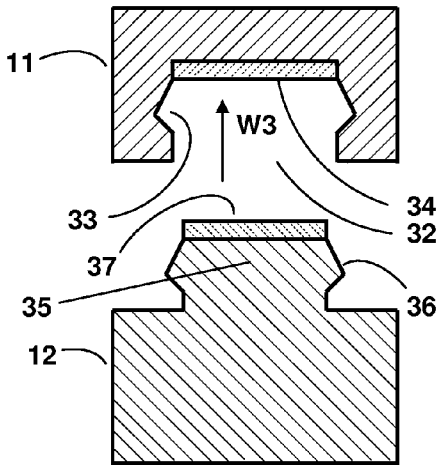
FIG. 4 shows an end view of the handle of the preferred embodiment of the articulating toothbrush showing the upper and lower portions of the handle separated before they are snapped together.

In FIG. 4 is shown an end view of toothbrush 10 from the handle end before its upper handle portion 11 and lower handle portion 12 are snapped together during assembly of toothbrush 10. Deliberately, no bristles or arcuate element 14 are shown to avoid cluttering this figure of the drawing. Along the length of the underside of the upper handle portion 11 there is a groove 32, and in the opposite side walls of groove 32 there are "V" shaped grooves 33. At the top of groove 32 there is a saw tooth ridged portion 34 that is best seen in and described with reference to FIG. 6B.

in FIG. 4 lower handle portion 12 has a plateau or raised portion 35 thereon that extends along the length of the top side of handle portion 12. On top of plateau 35 there is a raised portion 37 having saw teeth that are best seen in and described with reference to FIG. 6B. On the opposite side walls of plateau 35 are "V" shaped protrusions 36 that have the same shape as "V" shaped groove 33 in upper portion 11.

Figure 5:
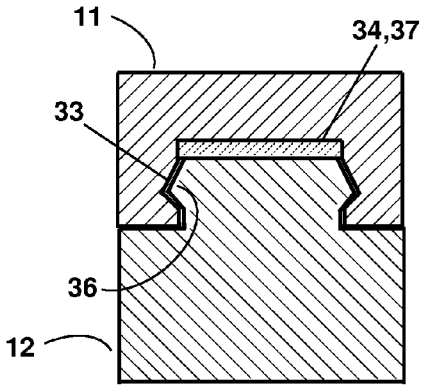
FIG. 5 shows an end view of the handle of the preferred embodiment of the articulating toothbrush showing the upper and lower portions of the handle snapped together.

With reference to FIG. 5, on assembly of upper handle portion 11 to lower handle portion 12, when lower handle portion 12 is snap connected to upper handle portion 11 plateau 35 is inserted fully into groove 32 of upper portion 11 as shown. There is a force that "V" shaped protrusions 36 experience as they enter groove 32 that momentarily deforms the side walls of upper handle portion 11 outward. Upon being fully inserted "V" shaped protrusions 36 lie within "V" shaped groove 33 as shown in FIG. 5. In addition, saw tooth raised portion 37 on top of plateau 35 lies within saw tooth raised portion 34 in groove 32. This is best seen in and described with reference to FIG. 7.

Figure 6A:
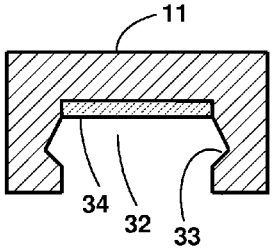
FIG. 6A is an end view of the upper handle portion showing the details of a channel in the underside thereof.
Figure 6B:
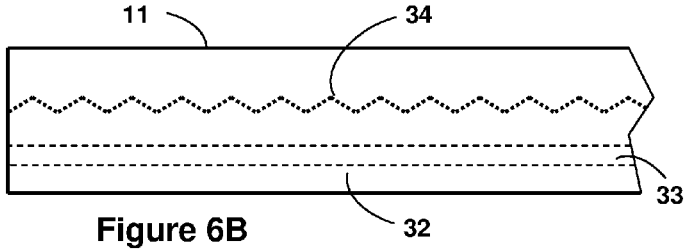
FIG. 6B is a side view of the upper handle portion 11.
Figure 6C:
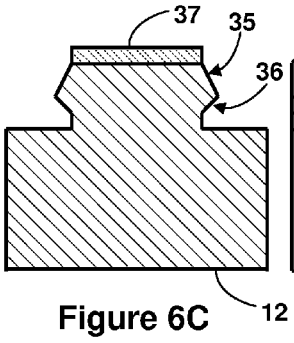
FIG. 6C is an end view of the lower handle portion 12 showing the details of a protrusion on top of the lower handle portion 12.

In FIG. 6A is again shown the end view (FIG. 4) of first/upper handle portion 11 alongside FIG. 6B which is a side view of a segment of upper handle portion 11. This is done to best correlate the elements of upper handle portion 11 between the end and side views in FIGS. 6A and 6B. In FIG. 6B raised portion 34 in the bottom of groove 32 is best seen to be a "sawtooth" ridge. In FIG. 6C is shown an end view (FIG. 4) of lower handle portion 12 alongside FIG. 6D which is a side view of a segment of lower handle portion 12. This is done to best correlate the elements of lower handle portion 12 between the end and side views in FIGS. 6C and 6D. In FIG. 6B raised portion 37 on top of plateau 35 is also seen to be a "sawtooth" ridge that is the same as saw tooth ridge 34 in FIG. 6B. When upper handle portion 11 and lower handle portion 12 are snap fit together they appear as shown in FIGS. 7A and 7B. It is best seen in FIG. 7B how the "sawtooth" ridge of raised portion 34 meshes with the "sawtooth" ridge of raised portion 37.

The meshed "sawtooth" ridges shown FIG. 7 are used to implement an adjustment mechanism for the novel articulating toothbrush 10. These "sawtooth" ridges are not shown in FIGS. 1A, 2A and 3A but may be utilized therewith. Without such an adjustment locking mechanism a person utilizing toothbrush 10 manually applies a linear force to upper portion 11 with respect to lower portion 12, such as indicated by arrows W1 and W2, to bend the bristled head at the outer end of upper portion 11 upward into a concave shape, as shown in FIG. 2A, or downward into a convex shape, as shown FIG. 3A. However, the user of toothbrush 10 must apply a continuing force to upper element 11 and lower element 12 to maintain the bristled head in either the concave or convex shape. When no such force is applied upper element 11 and lower element 12 will return to their neutral position, shown FIG. 1A, and the tips of bristles 16 will all lie in a flat plane.

Figure 6D:
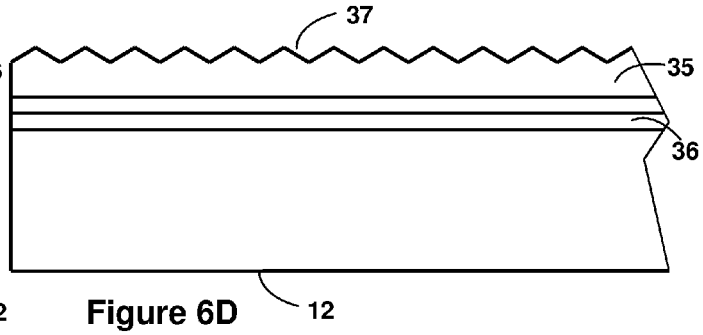
FIG. 6D is a side view of the lower handle portion 12.
Figure 7A:
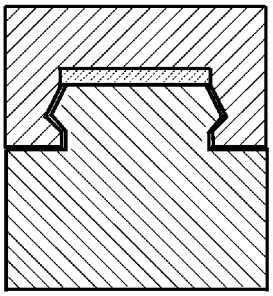
FIG. 7A is an end view of the upper handle portion snapped together with the lower handle portion.
Figure 7B:
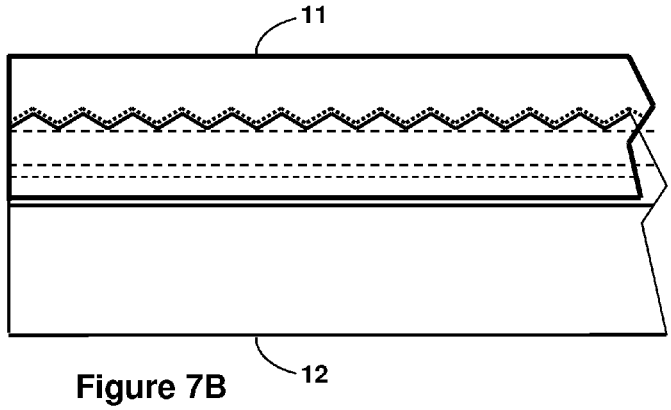
FIG. 7B is a side view showing the upper handle portion snapped together with the lower handle portion, to assemble the novel articulating toothbrush.

When toothbrush 10 has the "sawtooth" ridges shown in FIGS. 6B, 6D and 7B, as the user applies a linear force to upper portion 11 with respect to lower portion 12, such as indicated by arrows W1 and W2 in FIGS. 2A and 3A to bend the bristled head at the outer end of upper portion 11, the "sawtooth" ridges 34 of upper handle portion 11 are forced over the "sawtooth" ridges 37 of lower handle portion 12. After being so moved linearly the meshing "sawtooth" ridges will remain where they are at without a continuing force being applied to upper handle portion 11 with respect to lower handle portion 12. By having many "sawtooth" ridges a user of toothbrush 10 may adjust the degree of upward bend or downward bend of the bristled head at the outer end of upper portion 11. Alternately, a continuous row of "sawtooth" ridges need not be utilized. Rather, two single "V" shaped ridges may be utilized to lock upper handle portion 11 with respect to lower handle portion 12 at the furthest travel ends shown in FIGS. 2A and 3A. This latter alternative configuration is not shown in the drawings. The height of the saw tooth ridges, and the degree of their slope will determine the ease with which they will pass over each other and yet provide an efficient locking between the upper and lower handle portions 11 and 12. Preferably, the height of the saw teeth will be small although they are shown larger in FIGS. 6B, 6D and 7B only for the sake of understanding.

FIGS. 8A& 8B, 9A&9B and 10A&10B show an alternative embodiment 31 of the novel articulating toothbrush wherein upper handle portion 11 and lower handle portion 12 are held together by other than a "snap fit" means and adjustment and position locking of toothbrush 31 are accomplished in a different matter. The different manner in which this is accomplished is shown in and described with reference to FIGS. 11, 12, 13 and 14.

First, referring briefly to FIG. 15, and when alternative toothbrush 31 is assembled lower handle portion 12 is rotated in the direction of arrow W7 until it meets upper handle portion 11. At this position a three dimensional shaped "T" element 19 protruding from the top side of lower handle portion 12 deliberately does not line up with the wider left end (20*a* in FIGS. 8B, 9B and 10B) of hole 20. The top of the "T" element 19 has a diameter only slightly less than the diameter of larger hole portion 20*a* so element 19 can pass there through when the two are aligned.

With reference to FIG. 15, upper handle portion 11 is slid far enough to the right with respect to lower handle portion 12 until the "T" top of element 19 aligns with hole portion 20*a*. The "T" top is then pushed through hole portion 20*a*. When the sliding pressure on upper and lower handle portions 11 and 12 is released the "T" top of element 19 slides into the narrower portion of hole 20 and appears as in FIG. 8B. The diameter of the "T" top is wider than the width of the narrower portion of hole 20 so it cannot pass back through the narrower portion of hole 20. Upper handle portion 11 is held against lower handle portion 12 in a slidable manner for use of toothbrush 31.

Figure 8A:
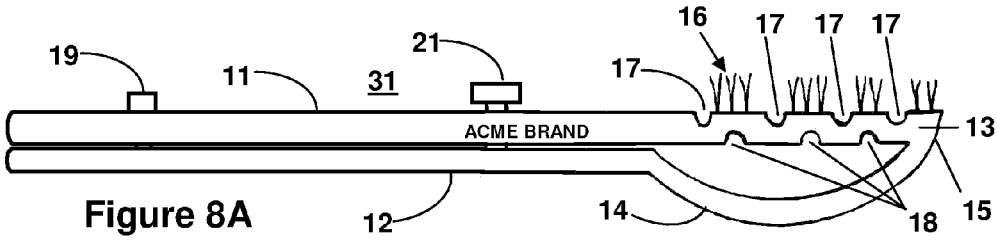
FIG. 8A shows a side view of an alternative embodiment of the novel articulating toothbrush in a neutral position in which the plane in which the tips of the bristles lie is flat.
Figure 8B:
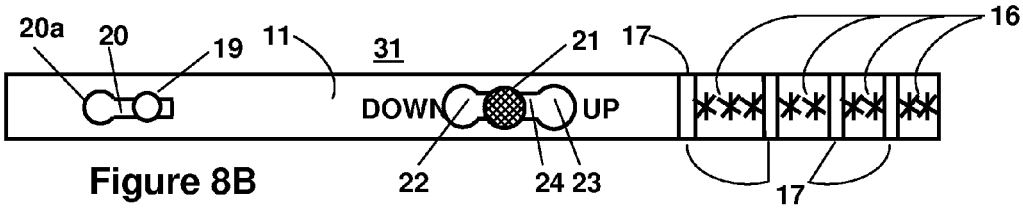
FIG. 8B shows a top view of the alternative embodiment of the novel articulating toothbrush in the neutral position in which the plane in which the tips of the bristles lie is flat.
Figure 9A:
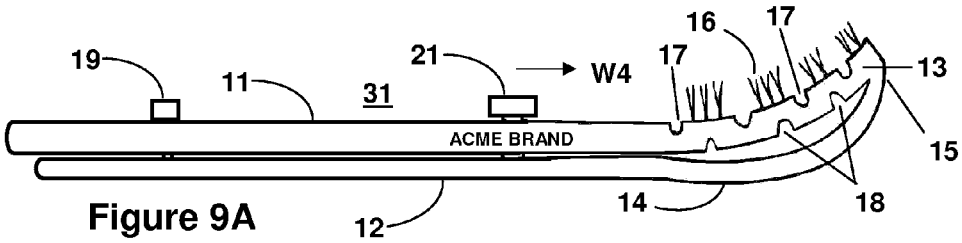
FIG. 9A shows a side view of the alternative embodiment of the novel articulating toothbrush adjusted to a first position in which the plane in which the tips of the bristles lie is concave.
Figure 9B:
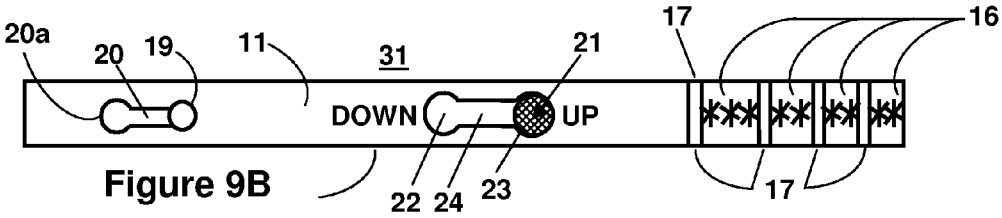
FIG. 9B shows a top view of the alternative embodiment of the novel articulating toothbrush adjusted to the first position in which the plane in which the tips of the bristles lie is concave.

Again with respect to FIG. 15, after lower handle portion 11 is rotated down onto upper handle portion 11 and is held there as described in the previous paragraph, circular extension 27 lies in the center of elongated hole or slot 24 and shown FIG. 8B. The diameter of extension 27 is only slightly less than the width of elongated slot 24 so it can move freely along the slot.

Figure 11:
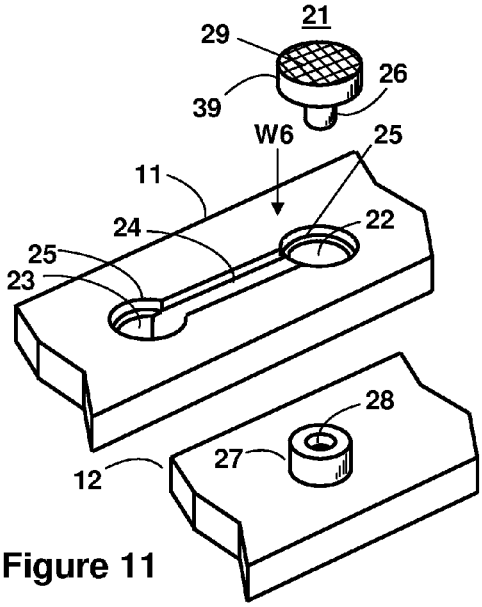
FIG. 11 is a three-dimensional drawing showing the actuating button of the alternative embodiment of the invention being assembled through the elongated slot through the upper portion of the toothbrush handle to the lower portion of the toothbrush handle in a slidable manner.

Turning to FIG. 11 to describe an actuating button 21 and how it is attached to be used to adjust the articulating toothbrush 31 between its flat, concave and convex positions shown respectively in FIGS. 8A, 8B and 8C. FIG. 11 is shown as an exploded view to better see all elements. As may be seen in FIG. 11 slot 24 has an elongated shape with rounded end portions 22 and 23. The width of the length of slot 24 is only slightly wider than the diameter of circular extension 27 so extension 27 easily enters slot 24. The rounded ends 22 and 23 of slot 24 each have a circular recess cut in the surface of upper handle portion 11 that is coaxial with the rounded ends. This creates a recess or ledge 25 at each of rounded ends 22 and 23 as shown in FIG. 11. The diameter of the recesses or ledges 25 at either end of slot 24 are only slightly larger than the diameter of the head 39 of button 21.

Circular extension 27 on lower handle element 12 has a circular hole 28 in its center as is seen in FIG. 11. The diameter of circular hole 28 is very slightly smaller than the diameter of a circular extension 26 extending from the bottom side of adjusting button 21. To attach button 21 upper handle portion 11 is slid far enough to the right with respect to lower handle portion 12 until extension 27 aligns with rounded end 22 of elongated slot 24 closest to the bristled head of toothbrush 31. This position is shown in FIG. 11. Although not shown in FIG. 11, extension 27 lies lengthwise in the center of slot 24 after upper handle portion 11 and lower handle portion 12 are held together by element 19 as previously described.

The circular extension 26 extending from the bottom side of adjusting button 21 is then inserted into hole 28 in the top center of extension 27 and is fastened to extension 27 by interference fit or by an adhesive. Button 21 has a grooved top 29 to make it easier to apply pressure thereto and slide upper and lower handle portions 11 and 12 with respect to each other to adjust toothbrush 31 between its different positions shown in FIGS. 8A, 8B and 8C.

Figure 12:
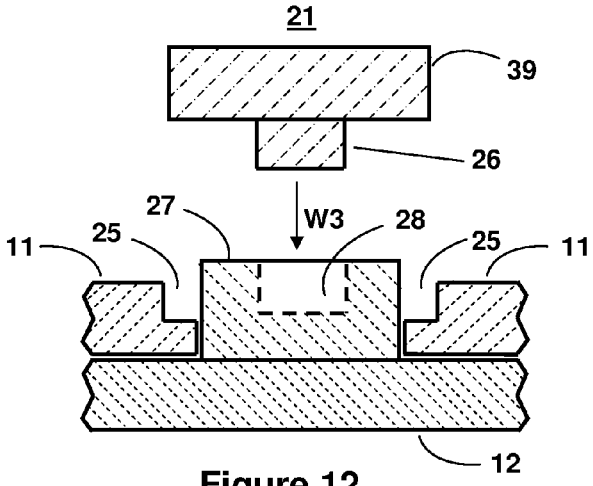
FIG. 12 shows an actuating button of the alternative embodiment of the invention being assembled to the articulating toothbrush and the button is manually used to adjust the bristles of the toothbrush to the first, second and third positions.

Turning to FIG. 12 therein is shown an exploded side view of the extension 27 of lower handle portion 12 extending through the end of slot 24 closest to the bristled head of toothbrush 31 and button 21 is about to be attached thereto by interference fit. Circular extension 26 on the underside of button 21 is being moved in the direction of arrow W3 to be inserted into hole 28 in the top of extension 27 to attach button 21 thereto.

Figure 13:
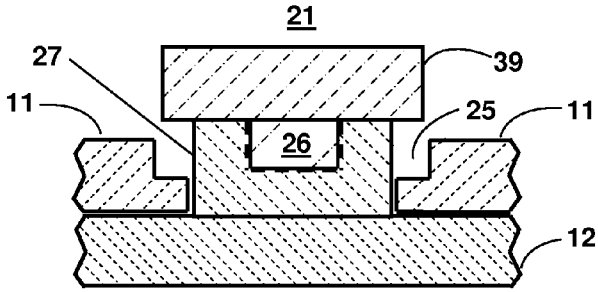
FIG. 13 shows the actuating button of the alternative embodiment of the invention in a raised position in which the articulating toothbrush may be adjusted between the first, second and third positions.

FIG. 13 is similar to FIG. 12 except it shows circular extension 26 fully inserted into hole 28 and the top of extension 27.

Figure 14:
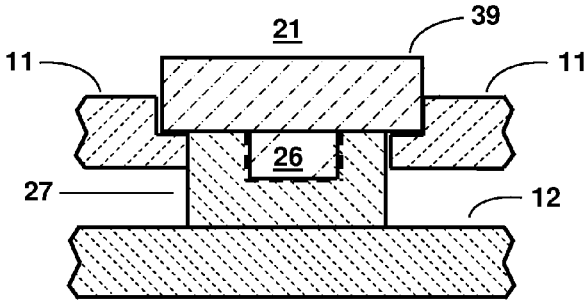
FIG. 14 shows the actuating button of the alternative embodiment of the invention in a lowered position in which it locks the bristles of the toothbrush in either the second or third positions.
Figure 10A:
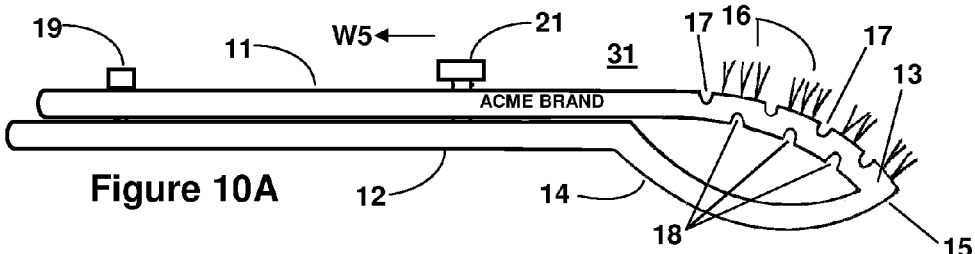
FIG. 10A shows a side view of the alternative embodiment of the novel articulating toothbrush adjusted to a second position in which the plane in which the tips of the bristles lie is convex.
Figure 10B:
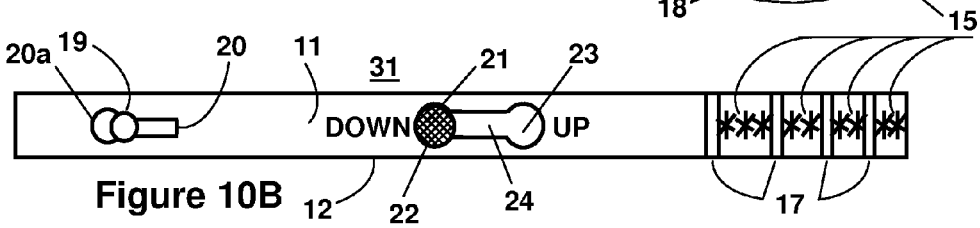
FIG. 10B shows a top view of the alternative embodiment of the novel articulating toothbrush adjusted to a third position in which the plane in which the tips of the bristles lie is convex.

FIG. 14 shows installed button 21 pushed down further so its actuating head 39 sits within recess 25. Due to the spring action of arcuate member 14, as previously described, head 39 will naturally remain within recess 25 once it has been pushed therein. As previously described with reference to FIGS. 8A and 8B head 39 of button 21 normally rests in slot 24 approximately midway between its rounded ends 22 and 23 when the tips of the bristles 16 lie in a flat plane. When button 21 is moved in the direction of arrow W4, as shown FIG. 9B, until it reaches the end of slot 24, any downward pressure on button 21 causes it to move downward into recess 25 at the rounded end 23 of slot 24 as shown in FIG. 14. The spring action of arcuate member 14 causes head 39 of button 21 to remain in recess 25. As a result, the user of toothbrush 31 does not have to maintain any pressure on button 21 to maintain toothbrush 31 and its bristles 16 in a concave state. Similarly, with reference to FIGS. 9A and 9B, when button 21 is moved in the direction of arrow W5, as shown in FIGS. 10A and 10*b*, until it reaches rounded end 22 of slot 24, any downward pressure on button 21 causes it to move downward into recess 25 at the rounded end 22 of slot 24 as shown in FIG. 14. As a result, the user of toothbrush 31 does not have to maintain any pressure on button 21 to maintain toothbrush 31 and its bristles 16 in a convex state. When it is desired to change the bristles 16 of toothbrush 31 from either their concave or convex state upper handle portion 11 and lower handle portion 12 are squeezed together to push head 39 of button 21 out of the recess 25 at either end of slot 24. A force may then be applied to button 21 to move it along slot 24 to a new position.

Figure 16:
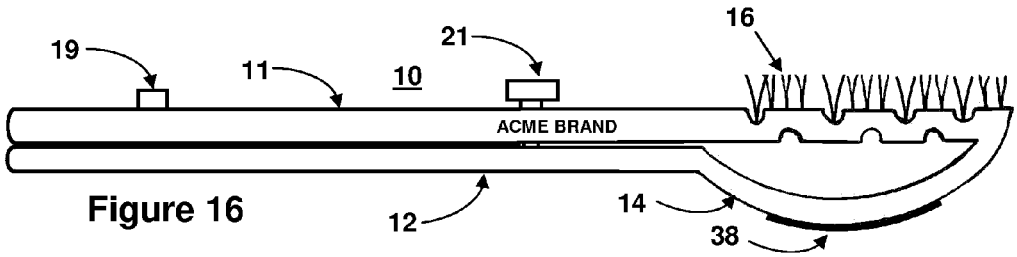
FIG. 16 shows another alternative embodiment of the invention in which additional bristles are added to the toothbrush, and on which a tongue scraper is added.

FIG. 16 shows another alternative embodiment of the invention in which additional bristles are added to the toothbrush, and in which a tongue scraper 38 is added. The additional bristles 16 are placed in and along the grooves 17 between the other bristles. In addition, a tongue scraper 38 may be added to the back or outer side of arcuate member 14. The surface of tongue scrapers and their use is well known in the art. While the alternative embodiment of the invention shown in FIG. 16 is shown with reference to the adjusting button 21 embodiment of the invention, the extra bristles and the tongue scraper 38 may be added to the preferred embodiment of the invention shown in FIGS. 1-3.

While what has been described herein is the preferred embodiment of the invention and two alternative embodiments those skilled in the art will understand that numerous changes may be made without departing from the spirit and scope of the invention.

The invention claimed is:

1. A toothbrush having an articulating head comprising:

an upper handle portion having a first handle end and a brush end, the brush end being furthest from the first handle end, and the first handle end has a top surface and a bottom surface and bristles extend from the top surface of the brush end; and a lower handle portion having a second handle end and an arcuate member furthest from the second handle end, and the second handle end has a top surface and a bottom surface;

wherein the bottom surface of the upper handle portion has an elongated first groove therein that is collinear with the upper handle portion and the first groove has a depth that does not extend through the upper handle portion, wherein the side walls of the first groove each have a second groove therein that is collinear with the first groove, wherein the top surface of the lower handle portion has an elongated first protrusion thereon that is collinear with the lower handle portion, and opposing sides of the first protrusion each have a raised second protrusion thereon, and when the upper handle portion and the lower handle portion are assembled together the elongated first protrusion is forced into the elongated first groove and the second protrusions and second grooves cooperate to hold the upper handle portion and the lower handle portion together in a way that the upper handle portion and the lower handle portion are held parallel to each other but can slide parallel to each other to create a force that changes the shape of the brush end of the upper handle portion of the articulating head toothbrush, and wherein the end of the brush end of the upper handle portion is connected to the end of the arcuate member and when the upper handle portion and the lower handle portion are slid parallel to each other in a first direction the brush end of the upper handle portion will curve in a first direction, and when the upper handle portion and the lower handle portion are slid parallel to each other in a second direction opposite to the first direction the brush end of the upper handle portion will curve in a second direction that is opposite the first direction.

2. The toothbrush of claim 1 comprising bristles that extend from the top surface of the brush end of the upper handle portion, the bristles are in groups and there are grooves in the top surface of the brush end between the groups of bristles, and wherein the grooves facilitate the brush end curving in the first direction and the second direction.

3. The toothbrush of claim 2 wherein there are grooves in the bottom surface of the brush end of the upper handle portion and wherein the grooves in the bottom surface further facilitate the brush end of the upper handle portion curving in the first direction and the second direction.

4. The toothbrush of claim 3 wherein adjacent grooves in the top surface of the brush end of the upper handle portion are spaced by different amounts to adjust how the brush end curves in the first direction and the second direction when the upper handle portion and the lower handle portion are slid parallel to each other.

5. The toothbrush of claim 4 further comprising bristles extending from the grooves in the top surface of the brush end of the upper handle portion.

6. The toothbrush of claim 4 wherein the grooves in the bottom surface of the brush end of the upper handle portion are spaced different distances from the distal end of the brush end than the grooves in the top surface of the brush end of the upper handle portion, the different distances further adjusting how the brush end curves in the first direction and the second direction when the upper handle portion and the lower handle portion are slid parallel to each other.

7. The toothbrush of claim 1 wherein the upper handle portion and the lower handle portion are made as one piece of plastic and the distal end of the brush end of the upper handle portion is connected to the distal end of the arcuate member of the lower handle portion to form a living hinge.

8. The toothbrush of claim 1 further comprising first locking elements at the bottom of the elongated first groove in the bottom surface of the upper handle portion, and second locking elements on the top of the elongated first protrusion on the top surface of the lower handle portion, and when the elongated first protrusion is inserted into the elongated first groove and is retained therein by the interaction of the second grooves and second protrusions the first locking elements mesh with the second locking elements to retain the position of the upper handle portion with respect to the lower handle portion after they are slid linearly with respect to each other.

9. The toothbrush of claim 8 where the first locking elements and the second locking elements each comprise a series of peaked ridges that mesh together.

10. The toothbrush of claim 1 further comprising a tongue scraper affixed to the arcuate member.

11. The toothbrush of claim 5 further comprising a first series of peaked ridges on the bottom surface of the elongated first groove in the bottom surface of the upper handle portion and a second series of peaked ridges on the top surface of the elongated first protrusion on the top surface of the lower handle portion, and the elongated first protrusion on the top surface of the lower handle portion is forced into the elongated first groove in the bottom surface of the upper handle portion to hold the upper handle portion and the lower handle portion together the first series of peaked ridges and the second series of peaked ridges mesh together to hold the upper handle portion and the lower handle portion in a position to which they are placed after they are slid parallel to each other.

12. The toothbrush of claim 11 wherein the upper handle portion and the lower handle portion are made as one piece of plastic and the distal end of the brush end is connected to the distal end of the arcuate member to form a living hinge.

13. The toothbrush of claim 12 further comprising a tongue scraper affixed to the arcuate member.

14. The toothbrush of claim 9 further comprising a tongue scraper affixed to the arcuate member.

15. The toothbrush of claim 14 wherein the upper handle portion and the lower handle portion are made as one piece of plastic and the distal end of the brush end is connected to the distal end of the arcuate member to form a living hinge.

* * * * *